United States Patent [19]

Curtis

[11] 4,160,425

[45] Jul. 10, 1979

[54] FUEL SYSTEM FOR AQUATIC CRAFT

[76] Inventor: Robert S. Curtis, 93 Woodbury Rd., Huntington, N.Y. 11743

[21] Appl. No.: 865,385

[22] Filed: Dec. 29, 1977

Related U.S. Application Data

[63] Continuation-in-part of Ser. No. 709,900, Jul. 29, 1976, abandoned.

[51] Int. Cl.[2] ..... B63B 35/00

[52] U.S. Cl. ..... 115/6.1; 261/69 A; 261/DIG. 8

[58] Field of Search ..... 115/6.1, 70; 261/69 A, 261/DIG. 8, DIG. 68

[56] References Cited

U.S. PATENT DOCUMENTS

| | | | |
|---|---|---|---|
| 3,174,738 | 3/1965 | Brown | 261/DIG. 68 |
| 3,406,653 | 10/1968 | Mela | 115/70 |
| 3,494,343 | 2/1970 | Nutten | 261/DIG. 68 |
| 3,630,165 | 12/1971 | Bottger | 115/6.1 |

*Primary Examiner*—Trygve M. Blix
*Assistant Examiner*—Jesus D. Sotelo
*Attorney, Agent, or Firm*—Michael I. Kroll

[57] ABSTRACT

A self-powered aquatic craft for moving individuals and objects through the water. A two-stroke-cycle internal combustion engine is provided with a diaphragm carburetor with an integral fuel pump which permits the craft to operate reliably in any position without flooding the engine. A manually operated priming device is employed in a novel manner to provide corrosion protection to the internal parts of the craft when it is not in use.

7 Claims, 4 Drawing Figures

FUEL SYSTEM FOR AQUATIC CRAFT

BACKGROUND AND DISCUSSION OF PRIOR ART

This is a continuation-in-part of application Ser. No. 709,900 filed July 29, 1976, now abandoned.

The present invention relates to the fuel system for an internal combustion powered aquatic craft adapted to move individuals and objects such as boats through the water where the internal combustion engine is designed to operate partially or completely submerged under water, except for a tube extending to the atmosphere to supply the engine with air.

The prior art exhibits many examples of self-powered aquatic craft as illustrated in U.S. Pat. Nos. 3,406,653, 3,630,165 and 3,763,817. The present invention relates to an improved fuel system for such types of aquatic craft as shown in U.S. Pat. Nos. 3,890,920, 3,908,578 and 3,630,165.

The prior art as exemplified by U.S. Pat. Nos. 3,890,920 and 3,908,578 shows a Rockwell JLO AQA SCOOTER with a float-type carburetor used in conjunction with an internal combustion engine said carburetor being waterproofed to the extent that the throttle shaft and the idle-mixture screw are sealed and the choke shaft has been eliminated and its hole plugged. Priming for starting is accomplished by tilting the craft forward at approximately a 45 degree angle until fuel appears in a clear plastic vent line connecting the float bowl to an air chamber located adjacent to the fuel tank indicating that fuel has flowed from the float bowl into the carburetor venturi through the main discharge nozzle. A significant disadvantage is that when the craft is in operation and the operator dives the carburetor will act as though it is being primed and the craft will stall from an over-rich fuel-air mixture.

The fuel tank is pressurized by combining exhaust gas pressure and the positive side of crank case pulse. This can be a dangerous condition if a backfire is transmitted to the fuel tank. Also, in warm weather, the pressure in the fuel tank will increase if the craft is stored in a car trunk and agitation from normal transportation will further increase the pressure. When the fuel valve is turned on the needle and seat assembly in the float carburetor is unable to control the excessively pressurized fuel and the engine will be flooded. The operator, being unaware of this, tilts the craft to prime it, but is priming an already flooded engine which results in extremely difficult starting.

Another disadvantage typical of the craft exemplified by the prior art is that their fuel systems offer no corrosion protection to the internal parts of the engine when the craft is not in use and often times causes seizing of the metal parts and results in costly repairs. The ramifications of this can be quite severe, as craft of these types are frequently used in salt water, the effects of which can lead to serious corrosion problems.

SUMMARY AND OBJECTS OF THE INVENTION

In the present invention the disadvantages of the prior art are overcome by replacing the float carburetor with a diaphragm carburetor with an integral fuel pump. This eliminates pressurizing the fuel tank with its inherent previously mentioned drawbacks. In addition, a diaphragm carburetor permits the craft to operate in any position, since it is not gravity sensitive as is a float-type carburetor. This represents a distinct advantage for a unit of this type. Additionally, the unit can be inverted to empty the air tank of water without flooding the engine with fuel. This is not possible with the float-type carburetor. The weight of the unit is also reduced and the overall reliability is markedly increased.

Accordingly, it is the object of this invention to provide a safe, light weight, reliable aquatic towing craft.

It is a further object of this invention to provide an aquatic towing craft equipped with a diaphragm carburetor with an integral fuel pump which will not be sensitive to position and therefore capable of operating in a greater variety of positions that its operator will find comfortable. Providing a carburetor that depends strictly on artifically created and controlled vacuum rather than on gravity accomplishes this end.

Another object of this invention is to provide an aquatic towing craft whose fuel tank is under atmospheric pressure for both safety and reliability.

Still another object of the present invention is to utilize a manual priming device (i.e., Nutten; U.S. Pat. No. 3,494,343) in a novel manner to lubricate and provide corrosion protection for the internal parts of the craft's engine when it is not in use for several days.

A further object of this invention is a system whereby any water accidentally introduced to the "dry" side of the carburetor control diaphragm will be automatically purged by the engine's induction system. This feature is not utilized by craft of this type using a diaphragm carburetor.

DESCRIPTION OF THE INVENTION

Figure 1:
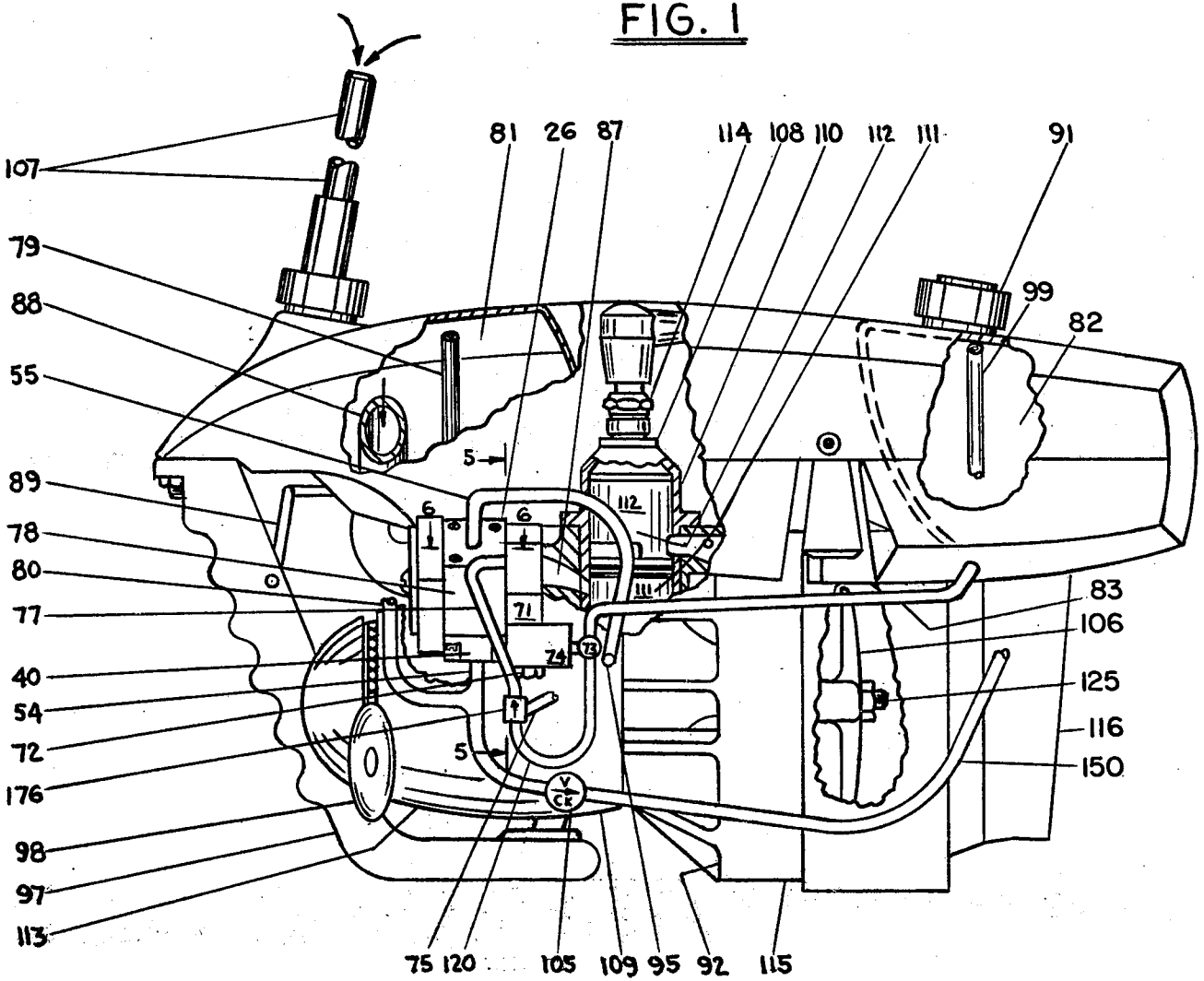
FIG. 1 is a side view in partial vertical cross section of an aquatic craft embodying the invention described herein.
Figure 4:
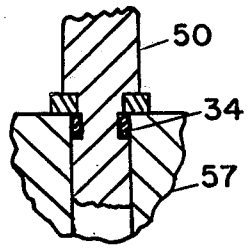

Referring to FIG. 1 of the drawings, an internal combustion engine generally designated 108 has a main body portion 109 shown partially in section and includes a cylinder 110. Piston 111 is reciprocally mounted in cylinder 110 which encloses combustion chamber 112. Housing 113 encloses a conventional recoil starter, the handle shown at 98. A magneto is enclosed within housing 113 and produces an electrical impulse which is conducted to the spark plug 114 by means of conductor (not shown). The electrical system and recoil starting system is made water tight to prevent short circuiting and water damage. The operation of said systems is well known in the art.

Propeller 106 is secured to shaft 125 which extends and is connected to crank shaft (not shown) to which piston 111 is connected, all connections of which are well known in the art. The entire assembly is disposed in a suitable housing.

Water is drawn into housing 115 through a plurality of openings 92 by the rotation of the propeller 106 and exits through housing 115 at 116 through suitably provided passage ways. The resultant thrust created by the exiting water propels the craft in a direction opposite to that of the emerging water.

Figure 3:
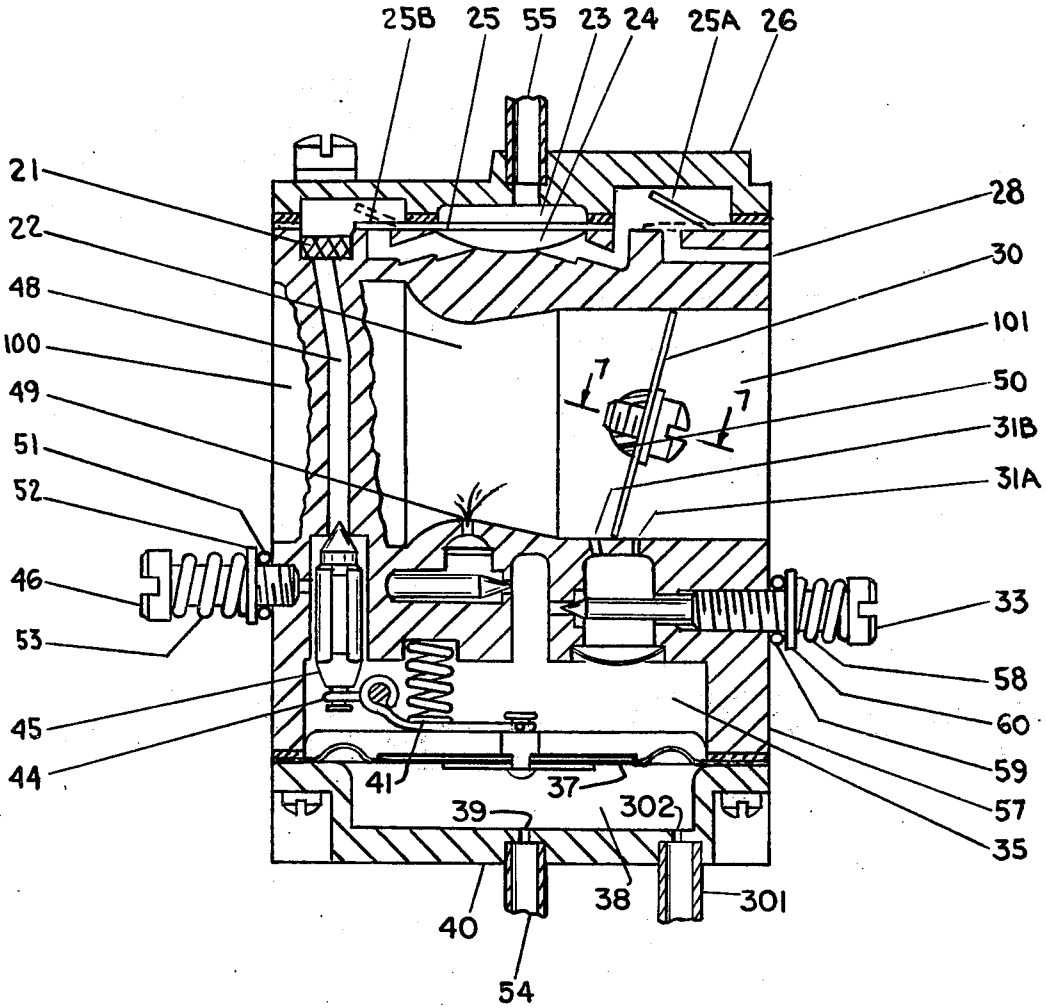
FIG. 3 is a section along lines 6—6 through the carburetor.

Handles 97 are provided on both sides of the craft and throttle linkage 89 is connected to throttle shaft 50 shown in FIG. 3. The handles are grasped so that the entire craft is contained within the extended arms of the operator and the chin of the operator's head is located in the area above the fuel tank cap 91.

Two separate tanks are provided as shown in FIG. 1. Air tank 81 is connected to atmosphere through tube 107 and is also vented to fuel tank 82 through tube 79 (the open end of tube 79 being positioned in the upermost section of air tank 81), tube 80, check valve 105, tube 150 and tube 99. Tube 99 is positioned at the top of fuel tank 82 in order to prevent fuel from entering the air tank.

Figure 2:
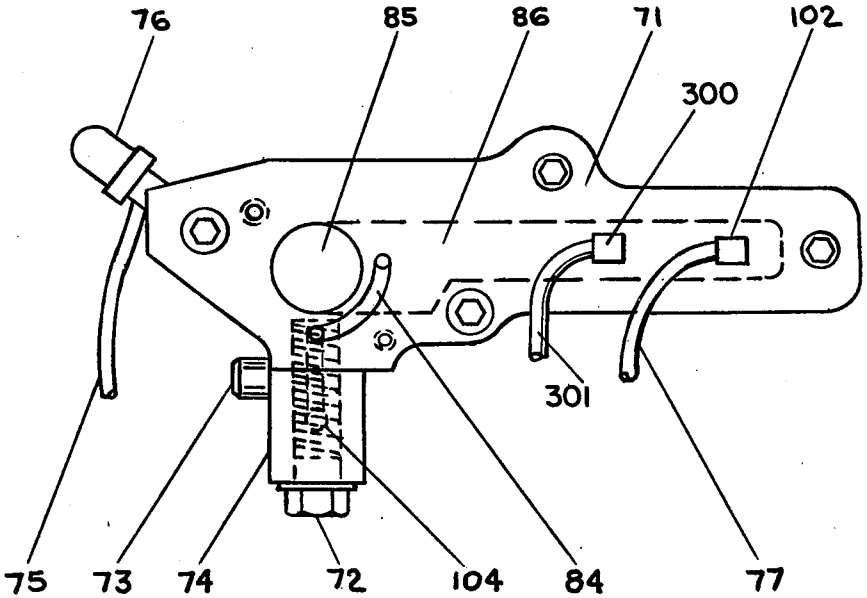
FIG. 2 is a view along lines 5—5.

As best shown in FIGS. 1, 2 and 3 a diaphragm carburetor assembly 78 is provided with an integral fuel pump. The cover of fuel pump 26 is connected to the engine crankcase port 95 by tube 55. Crankcase pulse, the alternating pressure-vacuum condition created in the crankcase with each up and down stroke of the piston is communicated to the fuel pump chamber 23. Pump diaphragm 25 pulsates when subjected to the crankcase pulse and creates alternate vacuum-pressure surges in fuel chamber 24. Fuel is drawn into the fuel chamber 24 from tube 83 which is positioned and sealed at the bottom of fuel tank 82. Fuel in tube 83 is communicated through shut off valve 73 into fuel block 74 through passage way 104 in bolt 72 into cavity 84 which is communicated to passage way 28 on carburetor body 57. Fuel is then pumped by pump diaphragm 25 operating in conjunction with inlet valve 25A and outlet valve 25B and flows through filter screen 21 through passage way 48 into metering chamber 35.

Air at atmospheric pressure is communicated through tube 107 which extends above the surface of the water into air tank 81. Air intake into the carburetor is through tube 88 which is positioned near the top surface of tank 81 to reduce the possibility that any water in tank 81 is not drawn into the air intake. Tube 88 is communicated to the carburetor intake 100. On the up stroke of piston 111 a partial vacuum is created in crankcase 109 and when piston 111 uncovers intake port 87 air is drawn through tube 88 into carburetor intake 100. As the air passes through the venturi 22 its velocity increases with a corresponding decrease in pressure causing fuel to be drawn from the main fuel port 49 into the air stream. The resulting fuel-air mixture is drawn through carburetor inlet 101 into passage 85 in intake manifold 71, through passageway 86, into intake port 87 and into crankcase 109. Throttle plate 30, idle fuel needle valve 33, main fuel needle valve 46, springs 53 and 58, primary idle port 31A and secondary idle port 31B are conventional in the art.

Diaphragm carburetor 78 is manufactured by Marvel-Schebler/Tillotson Division and is modified by removing the standard diaphragm cover (not shown) and incorporating a diaphragm cover 40 suitably vented to atmosphere as well as other modifications as hereinafter described. This invention is not limited to the modification of a Tillotson carburetor but can be used with any type of diaphragm carburetor such as Walbro and others. In the typical operation of a diaphragm carburetor, engine suction causes fuel from the main fuel port 49 to be drawn from metering chamber 35 creating a partial vacuum in said chamber. Atmospheric pressure in atmospheric chamber 38 acts on the metering diaphragm 37 causing it to move in the direction of the partial vacuum. Metering diaphragm 37 pushes diaphragm lever 44 which is connected to inlet valve 45 which opens and permits fuel to flow into metering chamber 35. When the pressure equalizes in both metering chamber 35 and atmospheric chamber 38 the inlet valve 45 is closed by the movement of spring 41. The higher the engine suction the more the metering diaphragm 37 moves thus allowing the carburetor to meet the fuel needs of the engine. Since metering chamber 35 is constantly under a slight vacuum the relative attitude of the carburetor has no bearing on its fuel-metering characteristic.

By providing a fuel pump the craft does not rely on gravity or contrived pressure systems for its fuel supply nor will the fuel pump produce pressures greater than those which can be controlled by inlet valve 45. The fuel tank is therefore vented to atmosphere and the problem of flooding by overpressurization of the fuel tank is eliminated.

The Tillotson carburetor as manufactured has its atmospheric chamber 38 vented to atmosphere by vent hole in diaphragm cover 40 (the as-manufactured diaphragm cover is not shown). If used on the AQUA-SCOOTER as originally designed and supplied it would not function under water since metering diaphragm 37 would not react strictly to engine suction but rather to water pressure which varies according to the depth of water in which it is placed. The Tillotson carburetor as manufactured will not operate more than 2 inches under water making its use without modification impossible for use on the AQUA-SCOOTER. Accordingly, to permit the operation of the diaphragm carburetor in an environment where other than atmospheric pressure exists on carburetor body 57, diaphragm cover 40 is provided with tube 54 which is connected to tube 80 which is connected to tube 79 in air tank 81. Tube 54 is also connected to the top of fuel tank 82 by tube 150 and 99 through check valve 105.

Pulsations in air tank 81 are caused by the engine's sudden request for air when piston 111 uncovers intake port 87 versus the inertia of the air mass in tube 107. When piston 111 closes intake port 87 the air mass in tube 107 is still moving into air tank 81. Accordingly, air tank 81 is alternately under a slight vacuum followed by a slight pressure and if the resultant pulsations were permitted to act on metering diaphragm 37, the metering of the fuel would not be in accordance with the engine requirements. This is overcome by providing restriction 39 in diaphragm cover 40 and sufficient volume in atmospheric chamber 38, resulting in non-pulsating atmospheric air being supplied to atmospheric chamber 38 of metering diaphragm 37.

Occasionally during the normal operation of craft of this type air intake snorkel 107 will be momentarily submerged causing the introduction of a quantity of water into air tank 81. If the water enters engine air intake 88 it will be ingested and vaporized by the combustion process. Occasionally, a quantity of water sufficient to stall the engine will be introduced to tube 88, but the engine can usually be restarted through ordinary means.

Occasionally however water in air tank 81 is communicated to the open end of carburetor vent tube 79 and then to atmospheric chamber 38 especially when the unit is disposed to the right. In addition condensation from normal use forms water droplets in said chamber. This water, however, will not be absorbed by the engine and its presence in chamber 38 will bias the carburetor toward a rich condition, most pronounced at low or idle speed operation. Since one of the objects of the present invention is to provide a reliable aquatic craft, special means are employed to automatically remove this water and pass it through the engine.

Atmospheric chamber 38 (FIG. 3) is connected from its lowest point to intake manifold 71. This connection is effected through 302 bleed restriction in diaphragm cover 40 which is fractionally the size of restriction 39 (the preferred size being 0.050 inch diameter). Sand bleed restriction 302 is communicated to passageway 86 in intake manifold 71 by tube 301 (FIG. 2) and fitting 300. During normal operation passageway 86 in manifold 71 is under a partial vacuum and air passes from chamber 38 through the bleed restriction, through the connecting tubing, and into passageway 86 in manifold 71. Since restriction 39 is factorially larger than the bleed restriction, air from tube 79 is admitted to chamber 38 at a greater rate than it can be withdrawn.

Accordingly when water accumulates in chamber 38 it is automatically removed by the bleed restriction 302 and passed through the combustion chamber at so slow a rate as not to have any adverse effects on the operation of the engine. Therefore, any air passing through the bleed restriction (as is the case during normal operation) is within compensatory means of the carburetor's fuel mixture adjustments.

Cold-starting of the craft is facilitated by the use of a manually operated priming device 76 as typified in U.S. Pat. No. 3,494,343, the primer administering a quantity of fuel to a convenient point in the engine's induction system. Said system however does not provide for lubrication of the engine's moving parts during non-use. However, the present invention overcomes this by introducing fuel (a gas-oil-mixture) in such a manner as to provide corrosion protection to the internal parts of the craft when it is not in use which is important since engines used near or underwater, especially salt water are subject to corrosion of their internal parts during storage for more than a few hours. Referring to FIGS. 1 and 2, fuel is introduced to fitting 102 into manifold 71 by tube 77. The fuel at this point passes through an orifice (not shown) in manifold 71, said orifice positioned in line with intake port 87, said orifice discharging the fuel in the form of a fine stream directed through the center of intake port 87. When the primer is operated with the piston at top dead center and the craft in its normal operating position fuel strikes the connecting rod (not shown) and proceeds down the face of the connecting rod to the big end bearing. Operation of the primer with the craft inverted 180° from its normal position will effect the same degree of protection for the wrist pin bearings. Further operation with the piston at bottom dead center will provide protection to the piston and piston rings. Accordingly the major internal moving parts of the engine are protected from corrosion during the time the engine is not in use, whether for a few days or an indefinite period.

Having regard to the foregoing disclosure, the following is claimed as the inventive and patentable embodiments thereof:

1. An improved self-powered aquatic craft for moving objects and individuals through water of the type having an internal combustion engine mounted in a housing wherein a propeller is mounted on a rotating shaft, said propeller drawing in water through the sides of said housing and thrusting said water through suitably positioned passageways, wherein the improvement comprises:

(a) a diaphragm carburetor having an atmospheric chamber and a diaphragm cover;
(b) a metering diaphragm mounted within the diaphragm carburetor;
(c) an integral fuel pump built into said diaphragm carburetor;
(d) means to automatically remove water from the atmospheric chamber of the diaphragm carburetor; and
(e) means to provide corrosion protection to the craft's internal moving parts during periods of non-use.

2. A self-powered aquatic craft in accordance with claim 1, further comprising:

(a) a fuel tank for storing fuel;
(b) an air tank;
(c) means for communicating pulsating atmospheric air to the diaphragm cover of the diaphragm carburetor; and
(d) means to restrict pulsations from influencing the movement of the metering diaphragm.

3. A self-powered aquatic craft in accordance with claim 2, in which the means to restrict pulsations from influencing the movement of the metering diaphragm is a restriction associated with the metering diaphragm and the atmospheric chamber.

4. A self-powered aquatic craft in accordance with claim 3, in which pulsating atmospheric air is communicated to the diaphragm cover of the diaphragm carburetor by conduit means associated with the air tank and the open end of the conduit being positioned in the uppermost section of the air tank.

5. A self-powered aquatic craft in accordance with claim 4, in which the restriction associated with the metering diaphragm is positioned in the diaphragm cover in order that only non-pulsating air acts on the metering diaphragm.

6. A self-powered aquatic craft in accordance with claim 5, in which the means to automatically remove water from the atmospheric chamber of the diaphragm carburetor consists of a bleed restriction said bleed restriction being factorially smaller than the restriction in the diaphragm cover, said bleed restriction positioned at the lowermost point in said atmospheric chamber and said bleed restriction communicated to the intake manifold of the engine by conduit means, said water in said atmospheric chamber being automatically removed by the suction created by the partial vacuum in said intake manifold.

7. A self-powered acquatic craft in accordance with claim 1, in which the means to provide corrosion protection to the craft's internal moving parts during periods of non-use consists of delivering fuel to the intake manifold by means of a manually operated priming device said fuel being delivered to a manifold having an orifice, said orifice positioned opposite the intake port of the engine so that a fine stream of fuel from the orifice is communicated from the orifice to the major internal moving parts of the engine.

* * * * *